United States Patent [19]

Fitzsimmons et al.

[11] 4,018,716

[45] Apr. 19, 1977

[54] RADIOGRAPHIC SYSTEM

[75] Inventors: Thomas W. Fitzsimmons, Bethel; Vincent Berluti, Jr., West Haven; Howard G. Wagner, Stamford; Jonathan S. Shapiro, Greenwich, all of Conn.

[73] Assignee: The Machlett Laboratories, Incorporated, Stamford, Conn.

[22] Filed: June 16, 1975

[21] Appl. No.: 587,447

[52] U.S. Cl. ..... 250/511

[51] Int. Cl.[2] ..... G21F 5/04; G21K 1/04

[58] Field of Search ..... 250/511, 320, 480

[56] References Cited

UNITED STATES PATENTS

| | | | |
|---|---|---|---|
| 3,502,872 | 3/1970 | Norgren | 250/511 |
| 3,511,995 | 5/1970 | Lombardo | 250/511 |
| 3,518,435 | 6/1970 | Kok | 250/511 |
| 3,581,094 | 5/1971 | Peyser et al. | 250/511 |
| 3,643,095 | 2/1972 | Shuster | 250/511 |
| 3,764,808 | 10/1973 | Lackey et al. | 250/511 |
| 3,920,997 | 11/1975 | Munch | 250/511 |

*Primary Examiner*—Alfred E. Smith
*Assistant Examiner*—T. N. Grigsby
*Attorney, Agent, or Firm*—John T. Meaney; Joseph D. Pannone; Harold A. Murphy

[57] ABSTRACT

A radiographic system comprising an X-ray source disposed to direct an X-ray beam through an adjustable shutter aperture in an aligned collimator and onto an image receptor in a holder located at a preselected distance from the source; and automatic means for preventing an X-ray exposure until prescribed operating conditions have been satisfied, the automatic means including read-only-memory means for storing the prescribed conditions therein and ascertaining whether or not the prescribed conditions have been met.

8 Claims, 4 Drawing Figures

RADIOGRAPHIC SYSTEM

BACKGROUND OF THE INVENTION

This invention relates generally to radiographic systems for producing visual images of an irradiated subject, and is concerned more particularly with an X-ray radiographic system having automatic control means for ensuring that prescribed operating conditions have been met before permitting an X-ray exposure to be taken.

A radiographic system generally includes an X-ray generator disposed to direct an X-ray beam through a collimator and onto a suitably spaced image receptor. The X-ray generator usually comprises an X-ray tube enclosed within a shielded housing and having an evacuated envelope wherein an electron emitting cathode is disposed for directing an electron beam onto a focal spot area of an anode target. Generally, the focal spot area is maintained as small as possible in order to function as a point source for the resulting X-ray beam radiating therefrom. The X-ray beam passes through an X-ray transparent window in the tube envelope and through an aligned port in the housing. Accordingly, the collimator may be mounted over the port such that the X-ray beam passes through an adjustable aperture therein formed by a plurality of X-ray absorbent shutters. Thus, the collimated X-ray beam is provided with a suitable cross-sectional size and configuration for impinging on the image receptor.

One type of image receptor in general use comprises a rectangular film supported in a close-fitting cassette which may be installed in a wall-type holder, or in a tray located beneath the surface of a conventional X-ray table. A suitable collimator for providing the X-ray beam with a conforming rectangular cross section is disclosed, for example, in U.S. Pat. No. 3,581,094 granted to L. F. Peyser and assigned to the assignee of this invention. The collimator described therein comprises two orthogonally disposed pairs of opposing pivotal plates made of X-ray absorbent material for forming a rectangular aperture through which the X-ray beam passes. Each pair of opposing pivotal plates is operatively connected to a respective rotatable shaft for simultaneous and corresponding adjustment to define the associated dimension of the rectangular aperture, independently of the other dimension thereof. Thus, a patient may be positioned between the collimator and the image receptor such that the collimated X-ray beam passes through only a selected portion of the patient and produces an X-ray image thereof on the X-ray film.

Public health laws now require that positive means be provided for preventing generation of the X-ray beam until it is ensured that prescribed operating conditions have been satisfied, and the incident cross-section of the X-ray beam conforms closely to the size of the receptor. After these conditions have been met, the incident cross section of the X-ray beam may be reduced to a size smaller than the size of the receptor. On the other hand, if the incident cross section of the X-ray beam is increased to a size larger than the receptor, it is required that generation of the X-ray beam be prevented in order to avoid exposing the patient to unnecessary X-radiation. Consequently, a number of prior art systems of the described type have been developed for complying with the requirements of the public health laws. However, these prior art systems generally are very costly and, consequently, are beyond the price range which general practitioners can afford.

Therefore, it is advantageous and desirable to provide a relatively simple and inexpensive radiographic system having means for ensuring that a patient will not be exposed to unnecessary X-radiation.

SUMMARY OF THE INVENTION

Accordingly, this invention provides a radiographic system comprising an X-ray source disposed to direct an X-ray beam through an adjustable aperture of an aligned collimator and onto an image receptor located at a preselected distance from the source, and automatic means for ensuring that prescribed operating conditions have been met prior to initiating generation of the X-ray beam. The image receptor may be installed in a tray supported beneath the upper surface of an X-ray table or may be installed in a tray supported in a wall-type holder. Consequently, the X-ray source and the collimator are rotatably supported, as a unit, for directing the collimated X-ray beam onto an image receptor installed in the table tray or onto an image receptor inserted into the wall tray.

The automatic means includes collimator orientation detector means for producing electrical signals indicative of the orientation of the X-ray source and the collimator relative to the respective image receptors; and SID detector means for producing electrical signals indicative of the X-ray source being spaced preselected distances from the image receptors. The automatic means also includes receptor size sensing means for producing electrical signals corresponding to the size of an image receptor installed in the table tray or in the wall tray; and collimator aperture size sensing means for producing electrical signals corresponding to the defining dimensions of the shutter aperture.

The automatic means includes a collimator monitoring unit electrically connected to the detector means and to the sensing means for receiving electrical signals therefrom. The collimator monitoring unit includes receptor multiplexing means for connecting to the output thereof electrical signals from the table tray sensing means or from the wall tray sensing means in accordance with electrical signals received from the collimator orientation detector means. The collimator monitoring unit also includes collimator multiplexing means for connecting to the output thereof electrical signals from the collimator aperture size sensing means in accordance with electrical signals received from the SID detector means. Connected to the respective outputs of the receptor multiplexing means and the collimator multiplexing means is electrical comparator means for comparing the signals corresponding to the size of the collimator aperture, with the signals corresponding to the size of the installed receptor. Thus, the electrical comparator means produces electrical signals indicative of whether the aperture size is correct, or whether the aperture should be closed or opened.

The collimator monitoring means also includes read-only-memory means operatively connected to the detector means and the sensing means for determining whether an acceptable source-to-image receptor distance (SID) has been selected, whether an image receptor has been installed in position to receive an X-ray image, and whether the X-ray source and collimator are properly oriented with respect to the image receptor. The collimator monitoring means also includes flip-flop gating means for ensuring that final adjustment of the collimator aperture to the desired size will be made uniformly in the closing direction.

BREIF DESCRIPTION OF THE DRAWINGS

For a better understanding of the invention, reference is made in the following more detailed description to the accompanying drawings wherein.

DESCRIPTION OF THE PREFERRED EMBODIMENT

Figure 1:
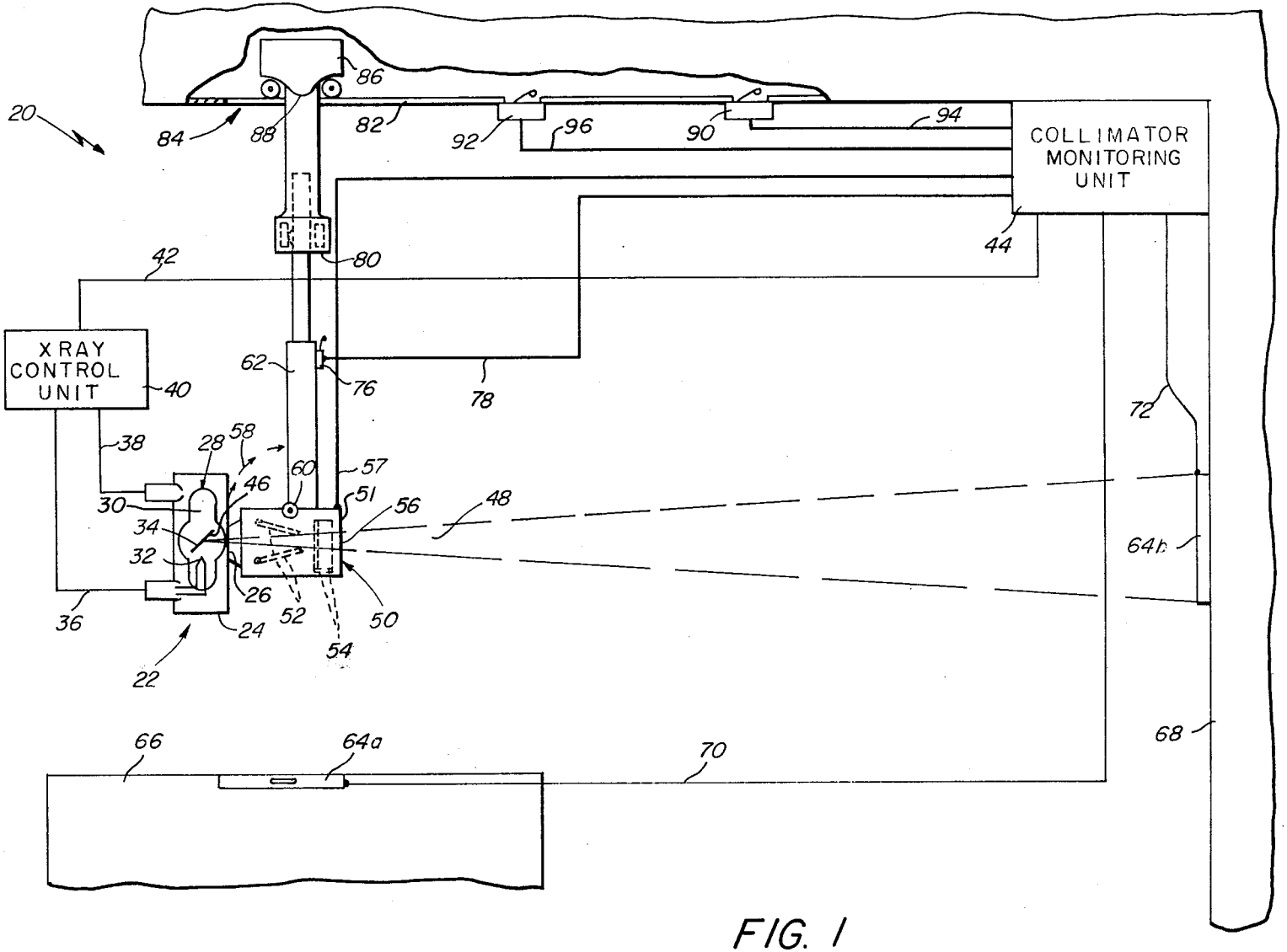
FIG. 1 is a pictorial view of a radiographic system embodying the invention.

Referring to the drawings wherein like characters of reference designate like parts throughout the several views, FIG. 1 shows a radiographic system 20 including a conventional X-ray generator 22 having a hollow cylindrical housing 24 provided with a port 26. Supported longitudinally within housing 24 is an X-ray tube 28 comprising an evacuated envelope 30 wherein an electron emitting cathode 32 is disposed in spaced opposing relationship with an anode target 34. Cathode 32 and anode target 34 are electrically connected through respective cables 36 and 38 to an X-ray control unit 40, which supplies electrical energy to the electrodes of X-ray tube 28 for the generation of X-rays. However, the X-ray control unit 40 also is electrically connected through a cable 42 to a collimator monitoring unit 44. The collimator monitoring unit 44, as will be shown, is provided with circuit means for delaying generation of X-rays by preventing electrical energy from reaching the electrodes of X-ray tube 28, until prescribed conditions for a safe X-ray exposure have been satisifed.

In operation, the cathode 32 of X-ray tube 28 directs an electron beam onto a focal spot area 46 of anode target 34 to generate a divergent X-ray beam 48 which emanates from the port 26 of generator 22. Mounted over the port 26 is a collimator 50 comprising a modification of the type described in U.S. Pat. No. 3,581,094 granted to L. F. Peyser and assigned to the assignee of this invention. Accordingly, collimator 50 is provided with a hollow housing 51 having therein two orthogonally disposed pairs, 52 and 54, respectively, of opposing pivotal plates which are made of X-ray absorbent material, such as lead for example. Each of the respective pairs 52 and 54 of opposing plates are pivotally mounted on a common shaft for simultaneous and corresponding movement toward and away from one another, independently of the other pair of plates. However, the respective pairs 52 and 54 of opposing pivotal plates cooperate with one another in defining a rectangular exit aperture, designated generally as 56, through which the X-ray beam 48 passes. As a result, the collimated X-ray beam 48 emerging from the collimator 50 is provided with a cross-sectional size and configuration determined by the rectangular aperture 56. The collimator 50 is connected electrically through a cable 57 to the collimator monitoring unit 44.

As indicated by the dashed line 58, the X-ray generator 22 and the collimator 50 are pivotally mounted on a pintle 60 which is supported at the distal end of a telescopic suspension post 62. Thus, the X-ray generator 22 and collimator 50 may be pivoted as a unit about the pintle 60 to direct the collimated X-ray beam 48 vertically downward onto a tray **64*a* located beneath the upper surface of an X-ray table 66. Consequently, a patient (not shown) may recline on the upper surface of table 66, and the collimated X-ray beam 48 may be directed through a preselected portion of the patient to impinge on a rectangular X-ray film installed in the tray 64*a*. Similarly, the X-ray generator 22 and the collimator 50 may be pivoted about the pintle 60 to direct the collimated X-ray beam 48 horizontally onto a tray 64*b* supported on a wall 68. Thus, a patient (not shown) may stand adjacent the tray 64*b*, and the collimated X-ray beam 48 may be directed through a preselected portion of the patient and onto a rectangular X-ray film installed in the tray 64*b*. The trays 64*a* and 64*b* may be similar in construction and are connected through respective cables 70 and 72 to the collimator monitoring unit 44**.

Suitably secured to a portion of the telescopic suspension post 62 is a detector switch 76 which is connected through a cable 78 to the collimator monitoring unit 44. The detector switch 76 is actuated by a shoulder 80 of the post 62 when the source 46 of X-ray beam 48 is spaced a predetermined vertical distance, such as 40 inches, for example, from an X-ray film in the tray **64*a*. Thus, an electrical signal indicative thereof is sent through the cable 78 to the collimator monitoring unit 44**.

The post 62 extends upwardly between spaced parallel rails 82, (only one of which is shown), in an overhead carriage assembly 84 and is fixedly attached to a support block 86 which is movable along the rails 82. The support block 86 is provided with a cam-shaped projection 88 for actuating detector switches 90 and 92, respectively, which are suitably supported on the rails 82. The switches 90 and 92 are electrically connected through respective cables 94 and 96 to the collimator monitoring unit 44, and are spaced respective distances from the wall 68, such as forty inches and seventy-two inches, respectively, for examples. Thus, when one of the switches 90 and 92 is actuated, an electrical signal indicative of the source 46 being located the associated distance from an X-ray film in tray **64*b* is sent to the collimator monitoring unit 44**.

Figure 2:
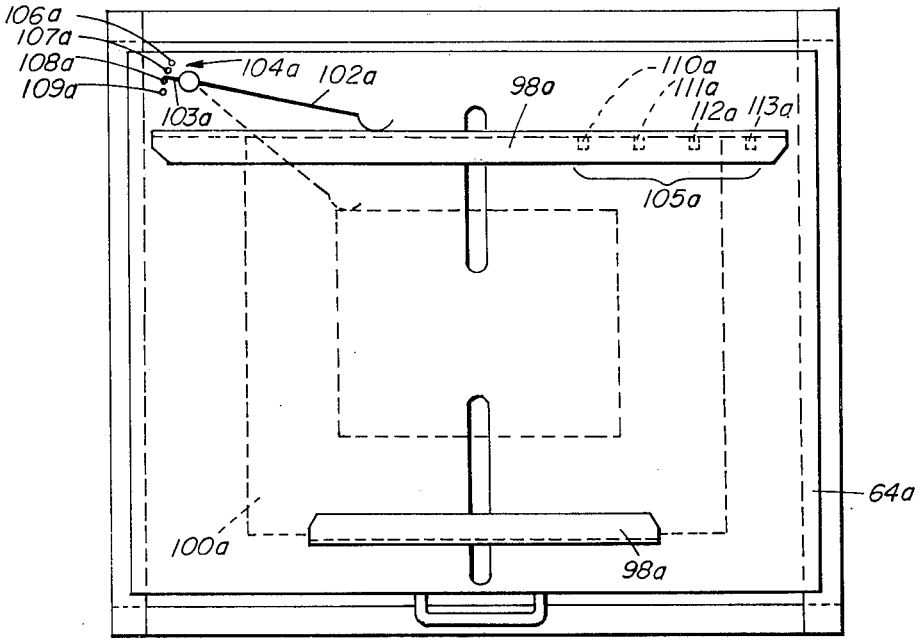
FIG. 2 is a plan view of the table tray shown in FIG. 1.

As shown in FIG. 2, the tray **64*a* which is in the table 66 is provided with a pair of spaced clamps 98*a* which are simultaneously movable toward and away from one another. The clamps 98*a* provide means for securing a film-bearing cassette, indicated as 100*a*, to the tray 64*a* in a position to receive an X-ray image. The cassette 100 is rectangular and has a dimension extending between the clamps 98*a* which, as shown in FIG. 1, extends across the X-ray table 66. Consequently, the dimension of cassette 100*a* defined by the spaced clamps 98*a* is commonly referred to as the "cross" dimension. Similarly, as shown in FIG. 1, the other dimension of the cassette 100*a* extends longitudinally of the X-ray table 66, and is commonly referred to as the "long" dimension. Generally, when referring to cassette sizes, the cross dimension is mentioned first and is followed by the long dimension. Thus, the tray 64*a*** is designed to accept standard cassette sizes, which may be expressed in inches, such as 8 × 10, 10 × 12, 14 × 17, and 17 × 14, for examples.

The cross dimension of the cassette **100*a* is sensed, in accordance with this invention, by a pivotal arm 102*a* having a curved distal end portion lightly engaging one of the clamps 98***a*. Thus, as the engaged clamp 98*a* is moved away from the transverse centerline of the tray 64*a* to accept a cassette 100*a*, the curved end of arm 102*a* is pivoted arcuately, thereby rotating in the oppostie angular direction an opposing end portion 103*a* which functions as the wiper arm of a rotatable switch 104*a*. Consequently, the end portion 103*a* sequentially engages contacts 106*a*, 107*a*, 108*a*, and 109*a*, respectively, which correspond to the respective cassette cross dimensions, such as 8, 10, 14, and 17 inches, for examples. The respective switch contacts 106*a*–109*a* are electrically connected through the cable 70 to the collimator monitoring unit 44.

The long dimension of the cassette 100*a* is sensed, in accordance with this invention, by a linear array 105*a* of spaced push-button switches 110*a*, 111*a*, 112*a*, and 113*a*, respectively, which are supported on one of the clamps 98*a*. The switches 110*a*–113*a* are spaced along the clamp 98*a* at respective distances from the longitudinal centerline of tray 64*a* so as to sense associated cassette long dimensions, such as 10, 12, 14, and 17 inches, for examples. The switches 110*a*–113*a* are actuated by inserting a cassette 100*a* and closing the clamps 98*a* against opposing edges thereof. However, in this instance, a cassette having a larger long dimension such as fourteen inches, for example closes not only the push-button switch associated therewith, but also the push-button switches such as 110*a* and 111*a*, for examples, associated with lesser long dimensions. The push-button switches 110*a*–113*a* also are electrically connected through the cable 70 to the collimator monitoring unit 44.

Since the wall tray 64*b* is similar in consturction to the table tray 64*a*, it need not be described in detail. Accordingly, similar features of the tray 64*b* will be referred to, in the foregoing description, by the corresponding numerals followed by a subscript *b*.

Figure 3:
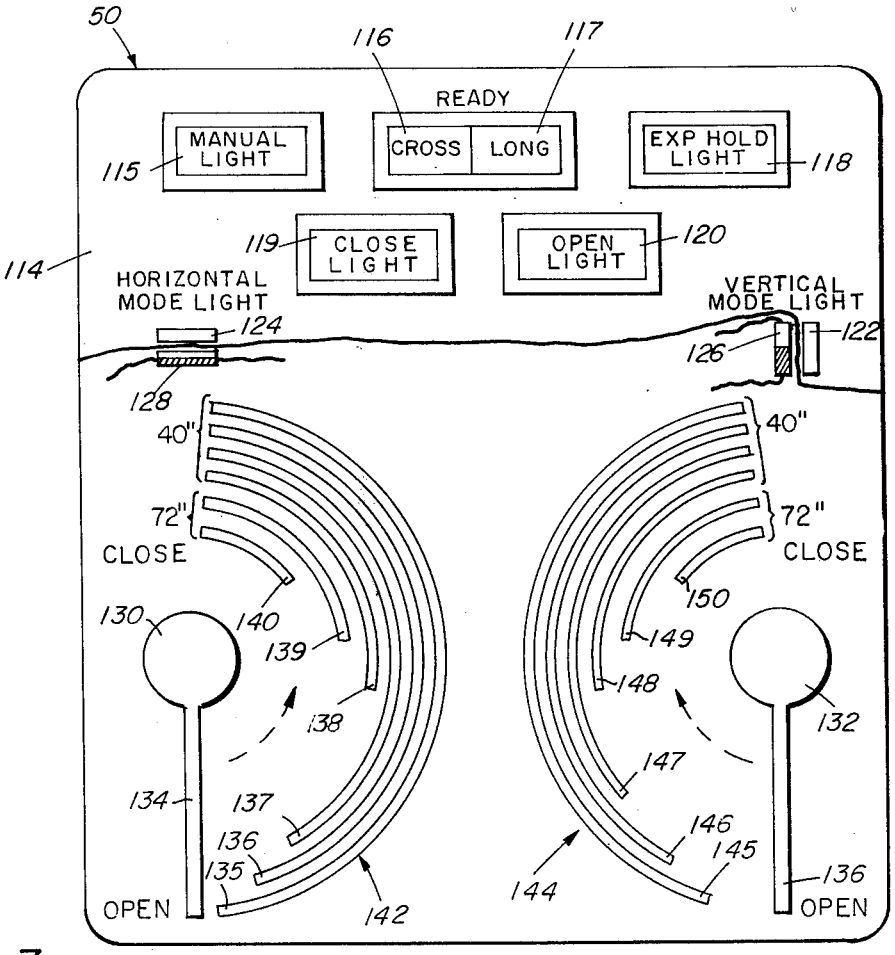
FIG. 3 is a side elevational view of the collimator shown in FIG. 1.

As shown in FIG. 3 the exterior of collimator 50 is provided with a control faceplate 114 having a "Manual" mode light 115, "Cross" and "Long" ready lights 116 and 117, respectively, an "Exposure Hold" light 118, and "Close" and "Open" shutter lights 119 and 120, respectively. The control faceplate 114 also includes a "Vertical Mode" light 122 and a "Horizontal Mode" light 124 which are associated with respective mercury switches 126 and 128 mounted within housing 51 of collimator 50. Thus, when the collimator 50 is directed vertically downward toward the tray 62*b* in the table 66, the mercury switch 126 is closed, and the "Vertical Mode" light 122 is illuminated. Similarly, when the collimator 50 is directed horizontally toward the tray 62*b* on the wall 68, the mercury switch 128 is closed, and the "Horizontal Mode" light 124 is illuminated.

The control faceplate 114 is provided with a pair of rotatable control knobs 130 and 132, respectively, which are provided for manually adjusting the respective pairs 52 and 54 of shutter plates shown in FIG. 1. Knob 130 is coupled to the shaft which pivots the pair 54 of shutter plates and thereby varies the cross dimension of the rectangular shutter aperture 56. Similarly, rotation of knob 132 controls the pair 52 of shutter plates and thereby varies the long dimension of the shutter aperture 56. In accordance with this invention, the control knob 130 also rotates an internal wiper arm 134 such that it sequentially and cumulatively contacts radially spaced conductors 135–140 of unequal length in an arcuate switch array 142 centered about the knob 130. The conductors 135–140, for example, may be plated on a conventional printed circuit board having an aperture through which the shaft for knob 130 protrudes. Similarly, the control knob 132 rotates an internal wiper arm 136 such that it sequentially and cumulatively engages radially spaced conductors 145–150 of unequal length in an arcuate switch array 144 centered about the knob 132.

The conductors 135–138 of switch array 142, when contacted by the arm 134, indicate that the pari 54 of opposing shutter plates are defining the associated dimension of aperture 56 appropriate for respective cross-dimension cassette sizes 17, 14, 10, and 8 inches, if the source 46 is spaced forty inches from the cassette 100*a*. On the other hand, the conductors 139 and 140, when contacted by the arm 134, indicate that the pair 54 of opposing shutter plates are defining the associated dimension of aperture 56 appropriate for respective cross-dimension cassette sizes 14 and 8, if the source 46 is spaced a distance of 72 inches from the cassette 100.

Similarly, the conductors 145–148 of switch array 144, when contacted by the arm 136, indicate that the pair 52 of opposing shutter plates are defining the associated dimension of aperture 56 appropriate for respective long dimension cassette sizes 17, 14, 12, and 10 inches, if the source 46 is spaced forty inches from the cassette 100. Also, the conductors 149 and 150, when contacted by the arm 36, indicate that the pair of 52 of opposing plates are defining the associated dimension of aperture 56 appropriate for respective long dimension cassette sizes 17 and 10 inches, if the source is spaced a distance of 72 inches from the cassette 100.

Thus, the knobs 130 and 132 may be adjusted to define the appropriate shutter aperture size for providing the X-ray beam 48 with a cross-sectional size conforming to the standard cassette sizes 8 × 10, 10 = 12, 14 × 17, and 17 × 14, respectively, when the source-to-image receptor distance is equal to 40 inches. Also, the knobs 130 and 132 may be adjusted to define the appropriate shutter aperture size for providing the X-ray beam 48 with a cross-sectional size conforming to the standard cassette sizes 8 × 10 and 14 × 17 inches, respectively, when the souce-to-image receptor distance is equal to 72 inches. Each of the conductors 135–140 and 145–150, and the respective wiper arms 134 and 136 are connected electrically through the cable 57 to the collimator monitoring unit 44. Accordingly, electrical signals indicative of the conductors 135–140 contacted by the wiper arm 134, and the conductors 145–150 contacted by the wiper arm 136 are sent to the collimator monitoring unit 44.

Figure 4:
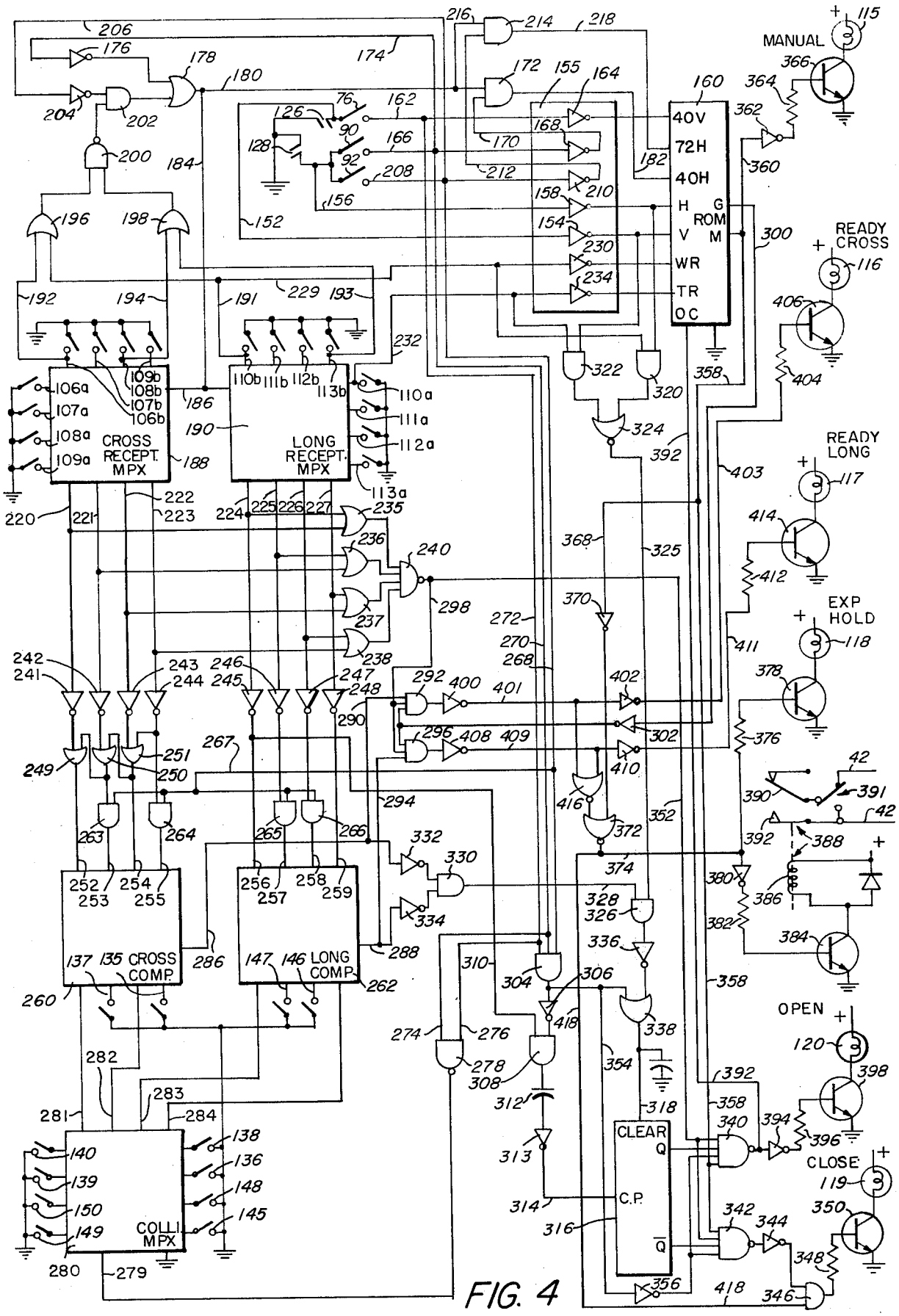
FIG. 4 is a schematic diagram of the circuitry in the collimator monitoring unit shown in FIG. 1.

As shown in FIG. 4, when the vertical mode mercury switch 126 is closed, by rotating the source 46 and the collimator 50 to direct the X-ray beam 48 vertically downward onto the table 66, the switch leg of the vertical SID switch 76 is connected to electrical ground. As a result, a logic 0 signal is sent through a connecting lead 152 to an inverter 154 in an inverter module 155. Consequently, the inverter 154 produces a logic 1signal and applies it to the input terminal V of a read-only-memory (ROM) device 160. On the other hand, when the horizontal mode mercury switch 128 is closed, by rotating the source 46 and collimator 50 to direct the X-ray beam 48 horizontally onto the wall 66, the respective switch legs of the horizontal SID switches 90 and 92 are connected to electrical ground. As a result, a logic 0 signal is sent through a connecting lead 156 to an inverter 158 which, consequently, applies a logic 1 signal to an input terminal H of the ROM 160. Thus, the ROM 160 is provided with the necessary data for determining whether the source 46 and collimator 50 are oriented to direct the X-ray beam 48 onto the cassette 100*a* in the table tray 64*a* or onto the cassette 100*b* in the wall tray 64*b*.

Accordingly, when the vertical mode switch 126 is closed and the vertical SID switch 76 is closed, a logic 0 signal is sent through a connecting output lead 162 to an inverter 164 which, consequently, applies a logic 1 signal to an input terminal 40V of the ROM 160. On the other hand, when the horizontal mode switch 128 and the horizontal SID switch 90 is closed, a logic 0 signal is sent through a connecting output lead 166 to an inverter 168 which, consequently, applies a logic 1 signal through a connecting output lead 170 to an input terminal of a forty inch horizontal sensing And gate 172. The output lead 166 also is connected through a conductor 174 to an inverter 176 which has an output lead connected to a respective input terminal of a horizontal SID sensing Or gate 178. Thus when the 40 inch horizontal SID switch 90 is closed, a logic 0 signal is sent through the conductor 174 to the inverter 176 which consequently applies a logic 1 signal to the connected input terminal Or gate 178. As a result, the Or gate 178 produces a logic 1 signal which is applied through a connecting output lead 180 to another input terminal of the forty inch horizontal sensing And gate 172. Accordingly, the And gate 172 produces a logic 1 signal and applies it through a connecting output lead 182 to an input terminal 40 H of the ROM 160.

The output of OR gate 178 also is connected through a conductor 184 to a select wall terminal lead 186 which is connected to respective input terminals of a cross receptor multiplexer device 188 and a long receptor multiplexer device 190. The respective contacts 106*b*–109*b* of the cross dimension sensing switch 104*b* on the wall tray 64*b* are connected to respective input terminals along one side of the multiplexer device 188. Also the respective push-button switches 110*b*–113*b* of the long sensing array 105*b* on the wall tray 64*b* are connected to respective input terminals along a corresponding side of the multiplexer device 190. As stated previously, only one of the contacts 106*b*–109*b* will be engaged by the switch arm 103*b*. On the other hand, the cassette 100*b* will actuate not only the pushbutton switch associated with its long dimension, but also all the push-button switches in the array 105*b* of lesser magnitudes. Accordingly, when the cassette 100*b* is installed in tray 64*b*, one of the cross dimension contacts 106*b*–109*b* will be connected to electrical ground. Simultaneously, the push button switch in the array 105*b* associated with the long dimension of cassette 100*b* and all the push-button switches in the series 110*b*–113*b* having associated long dimensions of lesser magnitude will be connected to electrical ground.

The cross dimension contacts 106*b* and 108*b*, which correspond to 8 and 14 inches, respectively, are connected through conductors 192 and 194 to input terminals of Or gates 196 and 198, respectively. Similarly, the long dimension push button switches 110*b* and 113*b*, which correspond to 10 and 17 inches, respectively, are connected through respective conductors 191 and 193 to other input terminals of the Or gates 196 and 198, respectively. Thus, when an installed cassette 100 *b* has a size of either 8 × 10 or 14 × 17 inches, which are the cassette sizes associated with an SID of 72 inches, one of the Or gates 196 and 198 will have applied to both input terminals thereof respective logic 0 signals. As a result, that Or gate will produce a logic 0 signal which will be applied to the associated input terminal of a Nand gate 200. Consequently, the Nand gate 200 will produce a logic 1 signal which will be applied to an input terminal of an And gate 202.

Another input terminal of the And gate 202 is connected through an inverter 204 and a connecting conductor 206 to the output lead 208 of the seventy-two inch SID switch 92. Thus, when the horizontal mode switch 128 and the SID sensing switch 92 are closed, a logic 0 signal is sent through the output lead 208 to an inverter 210 which, consequently, applies a logic One signal through a connecting output lead 212 to an input terminal of a 72 inch SID sensing And gate 214. Also, the logic 0 signal in output lead 208 is sent through the connecting conductor 206 to the inverter 204 which, consequently, applies a logic 1 signal to the connected input terminal of And gate 202. Accordingly, with a logic 1signal on both input terminals, the And gate 202 produces a logic 1signal which is applied through the conductor 184 to the select wall terminal lead 186. The logic 1 signal produced by And gate 202 also is applied through the output lead 180 and a connecting conductor 216 to another input terminal of the 72 inch SID sensing And gate 214. Accordingly, with a logic 1 signal on both input terminals, the And gate 214 produces a logic 1 signal which is applied through a connecting output lead 218 to an input terminal 72H of the ROM 160. Thus, the ROM 160 is provided with the necessary data for ascertaining whether the source 46 and the collimator 50 are directed horizontally toward the wall 66, and a source-to-image receptor distance of 72 inches has been selected.

The cross dimension contacts 160*a*–109*a* of the rotary switch 104*a* and the long dimension push-button switches 110*a*–113*a* of the linear array 105*a* on tray 62*a* are connected to respective input terminals along corresponding sides of the multiplexers 188 and 190, respectively. Thus, when the source 46 and the collimator 50 are oriented to direct the X-ray beam 48 onto cassette 100*a* and an SID of 40 inches is selected, there is a logic 0 signal applied to the "wall select" terminal lead 186. Consequently, the multiplexer 188 connects the cross dimension contacts 106*a*–109*a* to resepctive output terminal leads 220–223, and the multiplexer 190 connects the long dimension push-button switches 110*a*–113*a* to respective output terminal leads 224–227. On the other hand, when the source 46 and the collimator 50 are oriented to direct the X-ray beam 48 onto the cassette 100*b* and an SID of either 40 inches or 72 inches is selected, a logic 1 signal is applied to the select wall terminal lead 186, as previously described. As a result, the multiplexer 188 connects the cross dimension contacts 106*b*–109*b* to respective output terminal leads 220–223; and the multiplexer 190 connects the long dimension push-button switches 110*b*–113*b* to respective output terminal leads 224–227.

As stated previously, when a cassette is installed in either the wall tray 64*b* or the table tray 64*a*, it closes not only the push-button switch corresponding to its long dimension but also all the push-button switches corresponding to the long dimensions of lesser magnitude. Therefore, the push-button switch corresponding to the minimum long dimension, such as ten inches in this instance, will be closed when any one of the aforementioned cassette sizes is inserted in the tray. Accordingly, the respective push-button switches 110*a* and 110*b* may serve as detector means for producing respective electrical signals indicative of the insertion of a cassette in position to receive an X-ray image.

Consequently, the long dimension push-button switch 110*b* is connected through the conductor 191 and a connecting lead 229 to an inverter 230; and the long dimension push-button switch 110*a* is connected through a conductor 232 to an inverter 234. As a result, when a cassette 100*b* is installed in the wall tray 64*b*, the push-button switch 110*b* is closed thereby sending a logic 0 signal to the inverter 230. Accordingly, the inverter 230 produces a logic 1 signal and applies it to an input terminal WR of the ROM 160. Similarly, when a cassette 100*a* is inserted in the table tray 64*a*, a logic 0 signal is sent to the inverter 234 which, then, applies a logic 1 signal to an input terminal TR of the ROM 160, thus, the ROM 160 is provided with the necessary data for determining whether or not an image receptor is in position to receive an X-ray image.

The output terminal leads 224–227 of the long receptor multiplexer 190 are connected to respective input terminals of receptor size sensing Or gates 235–238, each of which has its output connected to a respective input terminal of a receptor sensing Nand gate 240. The other input terminals of Or gates 235–238 are connected to respective output terminal leads 220–223 of the cross receptor multiplexer 188. Thus, when a receptor having the maximum long dimension, such as 17 inches, for example, is installed in the table tray 64*a* or the wall tray 64*b*, all of the output terminal leads 224–229 will have applied thereto a logic 0 signal, which also is applied to the associated input terminals of the Or gates 235–238. On the other hand, only one of the output terminal leads 220–223, such as 222, for example, has applied thereto a logic 0 signal, which also is applied to the connected input terminal of Or gate 237. The other output terminal leads 220, 221, and 223 have applied thereto logic 1 signals, which also are applied to the associated input terminals of Or gates 235, 236, and 238, respectively. Consequently, the Or gates 235, 236, and 238 produce logic 1 signals which are applied to the connected input terminals of Nand gate 240. However, the Or gate 237 applies a logic 0 signal to the associated input terminal of Nand gate 240 thereby causing it to produce a logic 1 signal. Thus, a logic 1 signal on the output of Nand gate 240 indicates that a cassette having an acceptable size has been installed in a position to receive an X-ray image.

The output terminal leads 220–223 of the cross-receptor multiplexer 188 also are connected to respective inverters 241–244; and the output terminal leads 224–227 of the long receptor multiplexer 190 are connected to respective inverters 245–248. Thus, the logic 0 signals applied to the input terminal leads 220–227 are converted to respective logic 1 signals by the connected inverters 241–248, respectively. The inverters 241–243 have their outputs connected to respective input terminals of Or gates 249–251, respectively. The other input terminal of Or gate 249 is connected to the output of Or gate 250; and the other input terminal of Or gate 250 is connected to the output of Or gate 251, which has its other input terminal connected to the output of inverter 244. Thus, when a cassette having a maximum cross dimension, such as 17 inches, for example, is inserted into table tray 64*a* or wall tray 64*b*, the resulting logic 1 signal at the output of inverter 244 causes the Or gates 249–251 to produce respective logic 1 signals at their output. Accordingly, the Or gates 249–251, as connected to the output terminal leads 220–223 of the multiplexer 188 electronically produce a result similar to the physical layout of the push-button switches 110*a*–113*a* or 110*b*–113*b* with respect to an installed cassette.

The outputs of Or gates 249 and 251 are connected through respective terminal leads 252 and 254 to associated receptor input terminals of a cross digital comparator 260. Also, the outputs of inverters 245 and 248 are connected through respective terminal leads 256 and 259 to associated receptor input terminals of a long digital comparator 262. However, the outputs of Or gate 250 and the inverter 244 are connected to respective input terminals of And gates 263 and 264, respectively, which have their outputs connected through respective terminal leads 253 and 255 to associated receptor input terminals of comparator 260. Similarly, the inverters 246 and 247 have their outputs connected to respective input terminals of And gates 265 and 266, respectively, which have their outputs connected through respective terminal leads 257 and 258 to associated receptor input terminals of the comparator 262.

The other input terminals of And gates 263–266 are connected in common to a conductor 267 which is connected to a lead 268. The lead 268 together with leads 270 and 272 are connected to resepective output leads 208, 166 and 162, of the SID detector switches 92, 90, and 76, respectively. Thus, when the 72 inch SID is selected, a logic 0signal is applied through the lead 268 and the conductor 267 to the connected input terminals of And gates 263–266, respectively. Consequently, the And gates 263–266 will apply logic 0signals to the associated receptor input terminals of the comparators 260 and 262. As a result these receptor input terminals which correspond to respective cassette sizes 10 × 12 and 17 × 14 are disabled, since these cassette sizes are not used when an SID of 72 inches is selected.

On the other hand, when the 72 inch SID is not selected, a logic 1 signal is applied to the connected input terminals of the And gates 263–266. Consequently, when a logic 1signal is applied to the respective other input terminals of the And gates 263 to 266, a logic 1 signal is applied to the connected input terminals of the associated comparator devices 260 and 262. Thus, these input terminals of the comparator devices 260 and 262 are enabled to receive receptor size signals, when either a vertical SID or a horizontal SID of 40 inches is selected.

The leads 270 and 272 connected to the output leads 166 and 162 of the forty inch SID detector switches 90 and 76, respectively, are connected through conductors 274 and 276 to respective input terminals of a Nand gate 278. The output of Nand gate 278 is connected to a Select input terminal 279 of a collimator multiplexer 280. Connected along the left-hand side of collimator multiplexer 280, as viewed in FIG. 4, are arcuate contacts 139 and 140, respectively, of the switch array 142, and arcuate contacts 149 and 150, respectively, of the switch array 144. The contacts 139 and 149 are associated with the cassette size 8 × 10; and the contacts 140 and 150 are associated with the cassette size 14 × 17, which are the two cassette sizes used at an SID of 72 inches. Connected along the right-hand side of collimator multiplexer 280, as viewed in FIG. 4, are arcuate contacts 138 and 136, respectively, of the switch array 142 and arcuate contacts 148 and 145, respectively, of the switch array 144. The contacts 138 and 148 are associated with the similar cassette size 8 × 10; and the contacts 136 and 145 are associated with the similar cassette size 14 × 17 used at an SID of 40 inches. Connected along the upper side of collimator monitoring unit 280 are respective output terminal leads 281 and 282, which are connected to associated input terminals of the cross comparator 260, and respective output terminal leads 283 and 284 which are connected to associated input terminals of long comparator 262.

Thus, when an SID of 40 inches is selected, either in the horizontal mode or the vertical mode, a logic 0 signal will be sent through one of the respective leads 270 and 272 and through the connected conductors 274 and 276, respectively. Consequently, the Nand gate 278 will apply a logic 1 signal to the select terminal 279 thereby causing the collimator multiplexer 280 to connect the respective input terminals 138, 136, 148 and 145 to output terminals 281–284, respectively. On the other hand, when an SID of 72 inches is selected, both of the leads 270 and 272 will have applied thereto respective logic 1 signals. Accordingly, with logic 1 signals on both input terminals, the Nand gate 278 will produce a logic 0 signal and apply it to the select terminal 279 of the collimator multiplexer 280. As a result, the multiplexer 280 will connect the respective input terminals 139, 140, 149 and 150 to the output terminals 281–284, respectively.

Since the cassette sizes 10 × 12 and 17 × 14 are not used at an SID of 72 inches, the associated arcuate contacts 137 and 135, respectively, of the cross switch array 142 are connected directly to respective input terminals of the cross comparator 260. Also, the associated arcuate contacts 147 and 146, respectively, of the long switch array 144 are connected directly to respective input terminals of the long comparator 262. As noted previously, the corresponding receptor input terminals 253 and 254 of cross comparator 260 and receptor input terminals 257 and 258 of long comparator 262 are disabled when an SID of 72 inches is selected. Thus, even when a receptor size of 10 × 12 or 17 × 14 is inserted in position to receive an X-ray image and the collimator aperture 56 is properly adjusted, an X-ray exposure cannot be taken at an SID of 72 inches.

The respective comparators 260 and 262 are of the digital type and produce cumulative digital signals from binary coded signals on the receptor input terminals and the collimator input terminals, resepectively. The receptor digital signal is compared to a collimator digital signal to produce a resulting output signal. The cross comparator 260 applies its resulting output signal to a respective output terminal lead 286; and the long comparator 262 applies its resulting output signal to a respective output terminal lead 288. A logic 1 Signal on the output terminal lead 286 indicates that the cross receptor digital signal is equal to or greater than the corresponding cross dimension aperture signal. On the other hand, a logic 0 signal on the output terminal lead 286 indicates that the corresponding cross dimension aperture signal is greater than the cross receptor digital signal, and that the corresponding cross dimension of the shutter aperture 56 should be closed down. Similarly, a logic 1 signal on the output terminal lead 288 indicates that the long receptor digital signal is equal to or greater than the corresponding long dimension aperture signal. On the other hand, a logic 0signal on the output terminal lead 288 indicates that the corresponding long dimension aperture signal is greater than the long receptor digital signal, and that the corresponding long dimension of the shutter aperture 56 should be closed down.

The output terminal lead 286 is connected through a conductor 290 to a resepective input terminal of an And gate 292; and the output terminal lead 288 is connected through a conductor 294 to a respective input terminal of an And gate 296. As stated previously, when an accepted size cassette is installed in the table tray **64*a* or the wall tray 64*b*, the output of receptor sensing Nand gate 240 has applied thereto a logic 1 signal. Accordingly, the output of Nand gate 240 is connected through a conductor 298 to respective input terminals of the And gates 292 and 296, respectively. Also, a Generate output terminal G of the ROM 160 is connected through a conductor 300 and an inverter 302 to respective input terminals of the And gates 292 and 296, respectively. Thus, when the output terminal G of the ROM 160 has applied thereto a logic 0 signal, which is converted to a logic 1 signal by the inverter 302, it enables the And gates 292 and 296 to produce respective logic 1 signals. However, as will be shown, the ROM 160 will not apply a logic 0 signal to the output terminal G unless an open-close input terminal thereof has applied to it a logic 1 signal which is indicative of the shutter aperture 56** being closed down to the desired size.

The leads 268, 270 and 272 connected to respective output leads 208, 166, and 162 of the SID detector switches 92, 90, and 76, respectively, are connected to respective input terminals of an And gate 304. Thus, when an SID is selected, a logic 0 signal will be applied to one of the input terminals And gate 304 which, consequently, will produce a logic 0 signal. This logic 0 signal is converted by a connected inverter 306 to a logic 1 signal which is applied to a connected input terminal of an And gate 308. Another input terminal of the And gate 308 is connected through a conductor 310 to the input terminal 256 of the long comparator 280. As explained previously, any cassette size installed in tray **64*a* or 64*b* will cause a logic 1 signal to be applied to the input terminal 256 of the long comparator 280. Consequently, a logic 1 signal indicative of a receptor in position to receive an X-ray image is applied through the conductor 310 to the connected input terminal of And gate 308. Accordingly, with logic 1 signals on both input terminals, the And gate 308 produces a logic 1 signal and applies it to a connected pulse producing capacitor 312. The pulse, thus produced, is smoothed somewhat by a connected inverter 313 and applied to a Clock Pulse input terminal lead 314 of a flip-flop device 316. However, the pulse applied to input terminal lead 314 will not set the flip-flop gate 316 unless Clear input terminal lead 318 of the flip-flop 316** has applied thereto a logic 1 signal.

The inputs of inverters 230 and 234 are connected to respective input terminals of And gates 320 and 322, respectively, which have other respective input terminals connected to the outputs of inverters 158 and 154, respectively. Thus, if the source 46 and collimator 50 are directed at either the wall tray **64*b* or the table tray 64*a* and a receptor is installed in that particular tray, each of the And gates 320 and 322 will have a logic 0 signal applied to one input terminal thereof and a logic 1 signal applied to the other input terminal thereof. Consequently, both of the And gates 320 and 322 will apply respective logic 0 signals to connected input terminals of a Nor gate 324. Accordingly, the Nor gate 324 will produce a logic 1signal and apply it through a conductor 325 to a respective input terminal of an And gate 326.**

The other input terminal of And gate 326 is connected through a conductor 328 to an output of an And gate 330. The input terminals of And gate 330 are connected through respective inverters 332 and 334 to output terminal leads 286 and 288 of the comparators, 260 and 262, respectively. As stated previously, when the corresponding cross and long dimensions of the collimator aperture digital signals are greater than the associated receptor size signals, logic 0 signals are applied to the respective output terminal leads 286 and 288 of the comparator 260 and 262. Consequently, assuming that a logic 0 signal is on the output terminal lead 286 of cross comparator 260, it will be converted by inverter 332 to a logic 1 signal which will be applied to the connected input terminal of And gate 330. Also, assuming that a logic 1 signal is on the output terminal lead 286 of long comparator 262, it will be converted by inverter 334 to a logic 0 signal which will be applied to the connected input terminal of And gate 330. Thus, the And gate 330 will produce a logic 0 signal and apply it to the connected input terminal of And gate 326.

Accordingly, And gate 326 will produce a logic 0 signal which will be converted by inverter 336 to a logic 1 signal which will be applied to a connected input terminal of Or gate 338. The other input terminal of Or gate 338 is connected to the output of And gate 304 which has logic 0 signal applied thereto when a proper SID is selected. Thus, with a logic 1 signal on one input terminal and a logic 0 on the other input terminal, the Or gate 338 will produce a logic 1 signal which is applied to the Clear input terminal lead 318 of the flip-flop gate 316. As stated previously, the clock pulse on the input terminal lead 314 of flip-flop gate 316 will set the flip-flop only when a logic 1signal is applied to the Clear input terminal lead 318 of the flip-flop gate 316. Accordingly, when a receptor is installed or a proper SID is selected, the And gate 308 produces a logic 1 signal which causes capacitor 312 to produce the necessary clock pulse voltage signal and apply it through inverter 313 to the input terminal lead 314 of flip-flop gate 316. Consequently, a logic 1 signal applied to the Clear input terminal 318 when, the clock pusle is applied to the input terminal lead 314 of the flip-flop gate 316 will cause the gate 316 to set itself. As a result, a Q output terminal of the flip-flop gate 316 will have applied to it a logic 1signal; and a Q output terminal of gate 316 will have applied to it a logic 0 signal.

Thus, a logic 0 signal will be applied to an input terminal of Nand gate 342 connected to the Q output terminal of flip-flop gate 316. As a result, the Nand gate 342 will produce a logic 1 output signal which will be converted by a connected inverter 344 to a logic 0 signal and applied to a connected input terminal of an And gate 346. Consequently, the And gate 346 will produce a logic 0 output signal which will be applied through a load resistor 348 to the base terminal of a transistor 350. Accordingly, the transistor 350 will not be rendered conductive; and the close light 119, which is connected to the collector terminal of transistor 350, will not be illuminated.

On the other hand, a logic 1 signal will be applied to an input terminal of a Nand gate 340 connected to the Q output terminal of flip-flop gate 316. Also, when an acceptable size cassette is installed, as previously described, the receptor size sensing Nand gate 240 will produce a logic 1 signal, which will be applied through a connected conductor 352 to respective input terminals of Nand gates 340 and 342, respectively. Furthermore, when a proper SID is selected, the SID And gate 304, as previously described, produces an output logic 0 signal, which will be applied through a connected conductor 354 to the input of an inverter 356. Consequently, the inverter 356 will produce a logic 1 output signal which is applied to respective input terminals of the Nand gates 340 and 342, respectively. The respective other input terminals of Nand gates 340 and 342 are connected through a conductor 358 to a manual automatic output terminal M of the ROM 160.

When the ROM 160 determines from the described data input signals that the source 46 and the collimator 50 are properly oriented to direct the X-ray beam 48 onto an installed cassette, it is programmed to apply a logic 1 signal to the output terminal M. An inverter 362 connected through a conductor 360 to the output terminal M converts the applied logic 1 signal to a logic 0 signal, which is applied through a connected load resistor 364 to the base terminal of a transistor 366. Consequently, the transistor 366 is rendered nonconductive; and the Manual light 115, which is connected to the collector of transistor 366, is extinguished.

The output terminal M of ROM 160 also is connected through the conductor 358 and a connected conductor 368 to the input of an inverter 370. Thus, the applied logic 1 signal is converted by the inverter 370 to a logic 0 signal, which is applied to a respective input terminal of a Nor gate 372. Consequently, the Nor gate 372 produces a logic 1 output signal and applies it through a connected conductor 374 and a load resistor 376 to the base terminal of a transistor 378. As a result, the transistor 378 is rendered conductive; and the Exposure Hold light 118, which is connected to the collector of transistor 378, is illuminated.

The logic 1 signal applied through conductor 374 also is converted by a connected inverter 380 to a logic 0 signal, which is applied through a load resistor 382 to the base of a transistor 384. Consequently, the transistor 384 is rendered nonconductive; and an armature coil 386 of a relay 388 connected to the collector of transistor 384 is deenergized. Accordingly, a conductive arm 390 of relay 388 is withdrawn from electrical engagement with a relay contact 392, whereby an electrical signal permitting an X-ray exposure to be taken is not sent through the cable 42, which is connected through a key operable bypass switch 391 to the relay 388. As a result, an X-ray exposure cannot be taken until the Exposure Hold light 118 is extinguished or the system is returned to the Manual mode of operation.

The system is automatically returned to the Manual mode of operation by rotating the source 46 and the collimator 50 out of proper alignment with the cassette or by withdrawing the cassette from the tray. Thus, the input data signal to the ROM 160 from the associated mercury mode switch or from the associated receptor detector switch, respectively, will change from a logic 1 to a logic 0. In either instance, the ROM 160 is programmed to apply a logic 0signal to the output terminal M. As a result, the Manual light 115 will be illuminated; the Exposure Hold light will be extinguished; and the relay coil 386 of relay 388 will be energized to draw the relay arm 390 into electrical engagement with the contact 392. Accordingly, an electrical signal permitting an X-ray exposure to be taken, when desired, is sent through the cable 42 to the X-ray control unit 40.

Returning again to the situation where the ROM 160 has determined from the described input data signals that the X-ray source 46 and collimator 50 are properly oriented with respect to an installed cassette, there is a logic 1 signal applied to the output terminal M. The logic 1 signal is applied through the conductor 358 to respective input terminals of the Nand gates 340 and 342. Accordingly, with logic 1signals on all four input terminals, the Nand gate 340 produces a logic 0 signal which is applied through a conductor 392 to an OC input terminal of the ROM 160. The logic 0 signal produced by Nand gate 340 also is converted by a connected inverter 394 to a logic 1 signal which is applied through a load resistor 396 to the base terminal of a transistor 398. Consequently, the transistor 398 is rendered conductive; and the Open light, which is connected to the collector of transistor 398, is illuminated. With a logic 0 signal applied to the input terminal OC, the ROM 160 is programmed to apply a logic 1 signal to the output terminal G thereof. As noted previously, the logic 1 signal on output terminal G is applied through a connecting conductor 300 to an inverter 302 which converts the logic 1 signal to a logic 0 signal. Since this logic 0 signal is applied to respective input terminals of the And gate 292 and 296, an X-ray exposure is prevented while the Open light 120 is illuminated.

In accordance with the Open shutter light 120, the knobs 130 and 132 are rotated until the collimator aperture digital signals in the Cross and Long comparators, 260 and 262, respectively, are greater than the associated receptor size digital signals. Thus, both of the output comparator leads 286 and 288 will have applied thereto respective logic 0 signals, which are converted by the connected inverters 332 and 334 to respective logic 1 signals. Accordingly, with logic 1 signals applied to each of its input terminals, the And gate 330 will produce a logic 1 signal and apply it through conductor 328 to the connected input terminal of And gate 326. As described previously, there is a logic 1 signal applied to the other input terminal of And gate 326 from the output of Nor gate 324. Thus, with a logic 1 signal on each of its input terminals, the And gate 326 produces a logic 1 signal, which is converted to logic 0 signal by the connected inverter 336 and applied to a connected input terminal of the Or gate 338. As noted previously, when a proper SID is selected, the SID And gate 304 produces a logic 0 signal which is applied to the respective other input terminal of Or gate 338. Thus, with logic 0 signals on each of its input terminals, the Or gate 338 produces a logic 0 signal and applies it to the Clear input terminal lead 318 of flip-flop gate 316.

With a logic 0 signal on its Clear input terminal, the flip-flop gate 316 resets itself to its stable condition where a logic 0 signal is applied to the Q output terminal thereof and a logic 1signal is applied to the Q output terminal. In this stable condition, a clock pulse applied to the input terminal lead 314 of flip-flop gate 316 will not cause the gate 316 to set itself unless a logic one signal is applied to the Clear input terminal lead 318. Thus, with the flip-flop gate 316 in a stable condition, the logic 1 signal on output terminal Q is applied to the connected input terminal of Nand gate 342. As a result, the Nand gate 342 produces a logic 0 signal which is converted by connected inverter 344 to a logic 1 signal and applied to the connected input terminal of And gate 346. With a logic 1 signal applied to the other input terminal, the And gate 346 produces a logic 1 signal which is applied through the load resistor 348 to the base terminal of transistor 350. Consequently, transistor 350 is rendered conductive; and the Close light 119 connected to the collector of transistor 350 is illuminated.

On the other hand, the logic 0 signal on output terminal Q of flip-flop gate 316 is applied to the connected input terminal of Nand gate 340, which causes the Nand gate 340 to produce a logic 1 output signal. The connected inverter 394 converts the logic 1 output signal to a logic 0 signal and applies it through load resistor 396 to the base terminal of transistor 398. As a result, transistor 398 is rendered nonconductive; and the Open light connected to the collector of transistor 398 is extinguished. The logic 1 signal produced by the Nand gate 340 also is applied through conductor 358 to the OC input terminal of the ROM 160. With a logic 1 signal on the OC input terminal, the ROM 160 is programmed to apply a logic 0 signal to the output terminal G. This logic 0signal on output terminal G is applied through conductor 300 to the input of inverter 302. As a result, the inverter 302 produces a logic 1 signal and applies it to the respective connected input terminals of the And gates 292 and 296, respectively. However, as stated previously, the respective input terminals of And gates 292 and 296 connected to the comparator output leads 286 and 288, respectively, now have logic 0 signals applied thereto since the collimator aperture digital signals are larger than the receptor size digital signals.

Consequently, in accordance with the Close light 119, the knobs 130 and 132 are rotated until the collimator aperture digital signals in the Cross and Long comparators 260 and 262, respectively, are equal to the receptor size digital signals. Upon this occurrence, the comparators 260 and 262 apply respective logic 1 signals to the output terminal leads 286 and 288, respectively. Accordingly, these logic 1 output signals are applied to the connected input terminals of the And gates 292 and 296, respectively. Thus, with logic 1 signals applied to each of the input terminals of the And gates 292 and 296, respective logic 1 signals are produced at the outputs thereof. The logic 1 signal on the output of And gate 292 is converted by a connected inverter 400 to a logic 0 signal and applied through a conductor 401 to the input of another inverter 402. Consequently, the inverter 402 produces a logic 1 signal and applies it through a connected conductor 403 and a series connected load resistor 404 to the base of a transistor 406. As a result, the transistor 406 is rendered conductive; and the Ready Cross light 116, which is connected to the collector of transistor 406, is illuminated.

The logic 1 signal on the output of And gate 296 is converted by a connected inverter 408 to a logic 0 signal and applied through a conductor 409 to the input of another inverter 410. Consequently, the inverter 410 produces a logic 1 signal and applies it through a connected conductor 411 and a series connected load resistor 412 to the base of a transistor 414. As a result, the transistor 414 is rendered conductive; and the Ready long light 117, which is connected to the collector of transistor 414, is illuminated.

The logic 0 signals applied to the inputs of inverters 402 and 410, respectively, also are applied to respective connected input terminals of a Nor gate 416. Accordingly, the Nor gate 416 produces a logic 1 signal and applies it to a connected input terminal of the Nor gate 372. As noted previously, in the automatic mode of operation, there is a logic 0 input signal on the other input terminal of the Nor gate 372. Consequently, the Nor gate 372 produces a logic 0 output signal which is applied through the connected conductor 374 and series connected load resistor 376 to the base terminal of transistor 378. As a result, the transistor 378 is rendered nonconductive; and the Exposure Hold light 118 is extinguished.

The logic 0 signal applied through conductor 374 also is converted by the connected inverter 380 to a logic 1 signal, which is applied through the load resistor 382 to the base of transistor 384. Accordingly, the transistor 384 is rendered conductive; and the relay coil 386 is energized. As a result, the relay arm 390 is drawn into electrical engagement with the contact 392; and an electrical signal permitting an X-ray exposure to be taken, when desired, is sent through the cable 42 to the X-ray control unit 40.

The logic 0 signal produced by the Nor gate 372 also is applied through a connecting conductor 418 to a respective input terminal of And gate 346. Consequently, the And gate 346 produces a logic 0 signal, which is applied through the load resistor 348 to the base of transistor 350. As a result, the transistor 350 is rendered nonconductive, and the Close light 119 is extinguished.

Thus, there has been disclosed herein a radiographic system having automatic means for ensuring that the cross-sectional size of a collimated X-ray beam conforms to the image receptor size, prior to permitting an X-ray exposure to be taken.

From the foregoing, it will be apparent that all of the objectives of this invention have been achieved by the structures shown and described. It will also be apparent, however, that various changes may be made by those skilled in the art without departing from the spirit of the invention as expressed in the appended claims. It is to be understood, therefore, that all matter shown and described is to be interpreted as illustrative and not in a limiting sense.

What is claimed is:

1. A radiographic system comprising:

means for directing an X-ray beam from a source through an adjustable shutter aperture in an aligned collimator and onto an image receptor located at a preselected distance from the source; and automatic means connected to the source, the collimator, and the image receptor for ensuring that the cross-sectional size of the X-ray beam conforms to the size of the image receptor at the selected distance from the source, the automatic means including memory means disposed to receive electrical signals indicative of operating parameters and programmed to produce a desired output signal upon receipt of a prescribed series of operating parameters;

receptor detector means disposed for engagement with the image receptor and electrically connected to the memory means for producing electrical signals indicative of the image receptor in position to receive the X-ray beam; and orientation detector means connected to the collimator and electrically connected to the memory means for producing electrical signals indicative of the orientation of the shutter aperture with respect to the image receptor.

2. A radiographic system as set forth in claim 1 wherein the automatic means includes source-to-image distance detector means disposed for connection with the source and electrically connected to the memory means for producing electrical signals indicative of the source-to-image receptor distance.

3. A radiographic system as set forth in claim 2 wherein the automatic means includes receptor size sensing means disposed for engagement with the receptor for producing electrical signals indicative of a size defining dimension of the image receptor.

4. A radiographic system as set forth in claim 3 wherein the automatic means includes shutter aperture size sensing means connected to the shutter aperture defining means for producing electrical signals indicative of a defining dimension of the shutter aperture.

5. A radiographic system as set forth in claim 4 wherein the automatic means includes signal comparing means connected to the receptor size sensing means and to the shutter aperture size sensing means for comparing the dimension defining electrical signals from the receptor size sensing means with corresponding dimension defining electrical signals from the shutter aperture size sensing means and producing electrical output signals indicative of any difference therebetween.

6. A radiographic system as set forth in claim 5 wherein the automatic means includes logic gating means electrically connected between the output of the electrical comparing means and the output of the memory means for ensuring that the shutter aperture is adjusted in the closing direction in order to have the associated shutter aperture size signal in the electrical comparing means equal to the corresponding receptor size signal.

7. A radiographic system as set forth in claim 5 wherein the receptor size sensing means, the shutter size sensing means and the electrical comparing means are of the digital type.

8. A radiographic system as set forth in claim 7 wherein the automatic means includes multiplexing means connected between the electrical comparing means and the receptor size sensing means, and between the electrical comparing means and the shutter aperture size sensing means for routing respective corresponding receptor size and shutter aperture size digital signals to the electrical comparing means in a predetermined manner.

* * * * *

UNITED STATES PATENT OFFICE

CERTIFICATE OF CORRECTION

Patent No. 4,018,716 Dated April 19, 1977

Inventor(s) Thomas W. Fitzsimmons, Vincent Berluti, Jr., Howard G. Wagner, and Jonathan S. Shapiro It is certified that error appears in the above-identified patent and that said Letters Patent are hereby corrected as shown below:

Col. 5, line 5, "oppostie" should be -- opposite --; line 33 "consturction" should be -- construction --.

Col. 6, line 10, "pari" should be -- pair --; line 37, "10=12" should be -- 10 X 12 --.

Col. 12, line 28, after "terminal" second occurrence should read --"OC"--.

Col. 13, lines 54 & 57, "Q" should read -- $\overline{Q}$ --.

Col. 15, lines 62 & 68, "Q" should read -- $\overline{Q}$ --.

Signed and Sealed this thirtieth Day of August 1977

[SEAL]

Attest:

RUTH C. MASON
*Attesting Officer*

C. MARSHALL DANN
*Commissioner of Patents and Trademarks*